US005496095A

United States Patent [19]

Scholl

[11] Patent Number: 5,496,095

[45] Date of Patent: Mar. 5, 1996

[54] MINING MACHINE HAVING VERTICALLY MOVABLE PRIMARY AND SECONDARY CUTTERS

[76] Inventor: Rex Scholl, Rte. 1, Box 181, Given, W. Va. 25245

[21] Appl. No.: 309,972

[22] Filed: Sep. 20, 1994

[51] Int. Cl.[6] ..... F21C 27/24

[52] U.S. Cl. ..... 299/57; 299/68; 175/62

[58] Field of Search ..... 299/57, 61, 67, 299/68, 76; 175/62

[56] References Cited

U.S. PATENT DOCUMENTS

| | | | |
|---|---|---|---|
| 2,546,899 | 3/1951 | McCarthy | 299/55 |
| 2,801,092 | 7/1957 | Joy | 299/55 |
| 2,923,537 | 2/1960 | Wilcox | 299/56 |
| 2,940,740 | 6/1960 | Adams | 299/55 |
| 2,951,693 | 9/1960 | Carothers | 299/55 |
| 2,979,319 | 4/1961 | Anderson | 299/57 |
| 2,986,385 | 5/1961 | Densmore | 299/57 |
| 3,036,821 | 5/1962 | Letts | 299/55 |
| 3,245,723 | 4/1966 | Gonski | 299/57 |
| 3,304,123 | 2/1967 | Coffman | 299/57 |
| 3,526,285 | 9/1970 | Adkins et al. | 175/62 X |
| 4,036,529 | 7/1977 | Hawthorne et al. | 299/57 X |
| 4,400,036 | 8/1983 | Bradley | 299/59 |

FOREIGN PATENT DOCUMENTS

| | | | |
|---|---|---|---|
| 681181 | 9/1979 | U.S.S.R. | 299/57 |
| 744126 | 6/1980 | U.S.S.R. | 299/57 |

*Primary Examiner*—David J. Bagnell
*Attorney, Agent, or Firm*—Brady, O'Boyle & Gates

[57] ABSTRACT

A mining machine for mining coal from outside a hill containing a coal seam wherein a plurality of cutter drums and rotary cutters are pivotally and detachably connected to a pan having an auger conveyor rotatably mounted therein. Certain cutter drums and the rotary cutters are movable in a vertical plane to allow the operator to control the direction of the hole being drilled, and to accommodate the machine to different seam thicknesses or hole heights. A plurality of thrust and torque transmitting units are connected end-to-end between the auger conveyor drive shaft and a prime mover positioned outside the seam tunnel for conveying the cut coal out of the tunnel.

10 Claims, 8 Drawing Sheets

MINING MACHINE HAVING VERTICALLY MOVABLE PRIMARY AND SECONDARY CUTTERS

BACKGROUND OF THE INVENTION

Coal mining or augering machines operated by internal combustion engines have been employed for mining coal from outside a hill containing a coal seam, whereby a high percentage of the outcropping coal is removed. These mining machines usually include an auger having a cutting head which is advanced longitudinally into the seam during the mining operation to a depth of approximately two hundred feet to form a cylindrical hole in the coal seam. The auger, which is usually made up of a series of auger sections, detachably connected end-to-end, conveys the cut coal to a point of discharge outside the seam.

To increase the yield of a given seam, multiple cutting heads have been employed to form a series of parallel, cylindrical holes in the coal seam, whereby a large amount of coal remains in place in the seam because the shape of the holes leaves thick webs between the holes. To further increase the yield of the seam, it has been proposed to construct and arrange a plurality of cutting heads in such a manner to form a hole having a substantially square cross-section.

While these coal mining machines have been satisfactory for their intended purpose, they have been characterized by being quite large and thus difficult to control for changing the direction of the holes. These machines are also expensive and thus unaffordable by the small coal operator.

SUMMARY OF THE INVENTION

After considerable research and experimentation, the mining machine of the present invention has been devised to overcome the disadvantages experienced witch heretofore employed mining machines, and comprises, essentially, a pan having an auger conveyor rotatably mounted therein. A first set of primary drum cutters are connected to the forward end of the conveyor drive shaft and a secondary set of rotary cutters are mounted on the pan above the primary drum cutters and are operatively connected to the conveyor drive shaft. A fluid motor is operatively connected to the first set of primary drum cutters for moving the cutters in a vertical plane, to thereby allow the operator to control the direction of the hole. Another fluid motor is operatively connected to the secondary set of rotary cutters for moving the cutters in a vertical plane relative to the lower drum cutters to allow the machine to accommodate different seam thicknesses or hole heights.

Where the desired height of the hole to be cut is greater than the diameter of the primary drum cutters and secondary rotary cutters at the top height of their adjustment away from the bottom primary drum cutters, a third row of cutters is adapted to be positioned above and operatively connected to the secondary rotary cutters, to thereby be driven by and movable with the secondary rotary cutters, whereby the height of the cut is increased by the diameter of the third row of cutters.

A plurality of thrust and torque transmitting units are sequentially connected between the auger conveyor drive shaft and prime mover, such as an internal combustion engine, positioned outside the seam tunnel, whereby the cut coal is conveyed out of the tunnel.

DESCRIPTION OF THE PREFERRED EMBODIMENT

Figure 2:
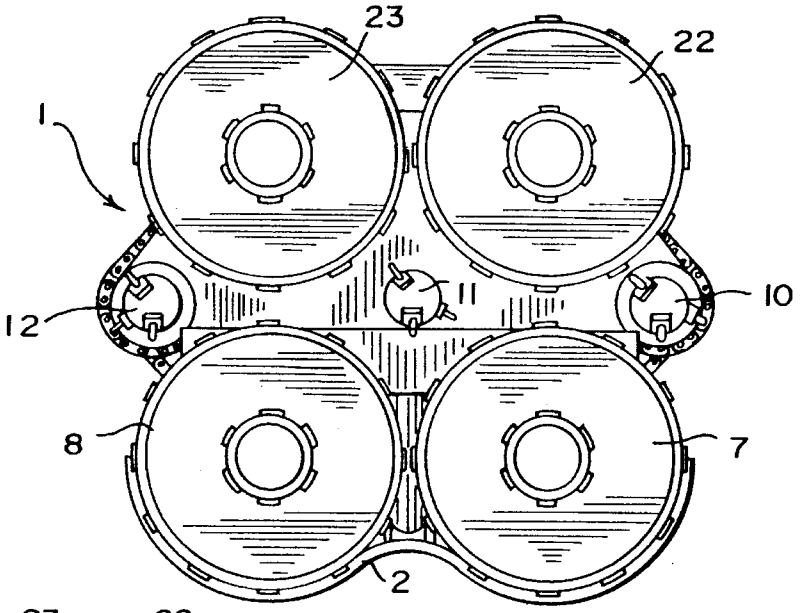
FIG. 2 is a front elevational view of the mining machine shown in FIG. 1.
Figure 1:
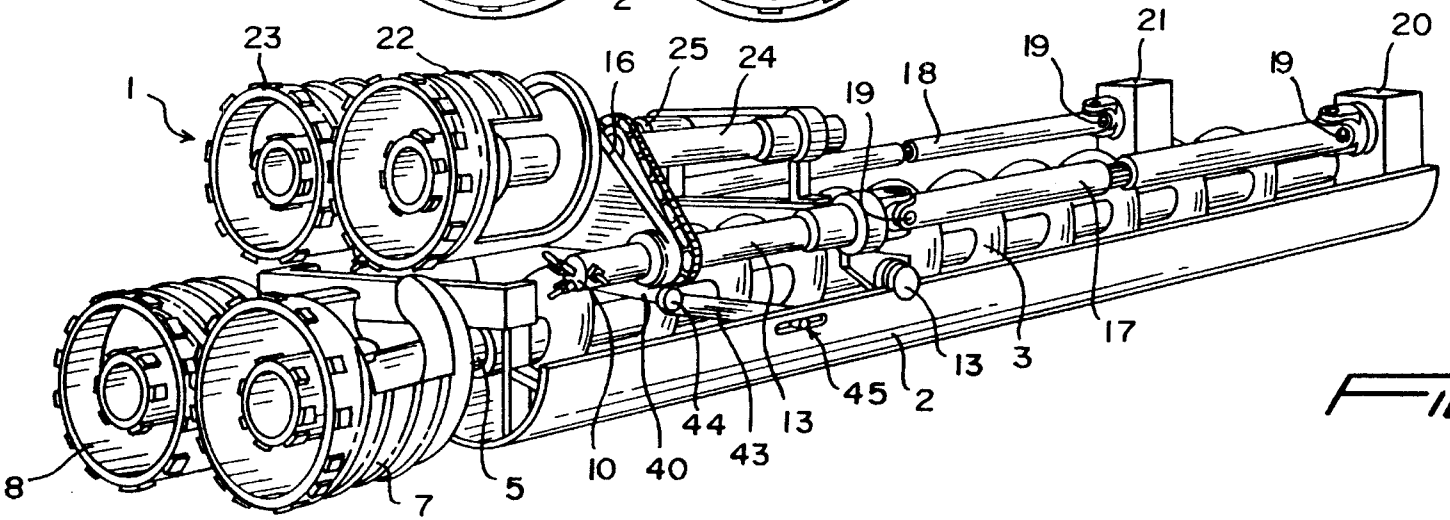
FIG. 1 is a perspective view of the mining machine of the present invention wherein three rows of cutters are employed.
Figure 3:
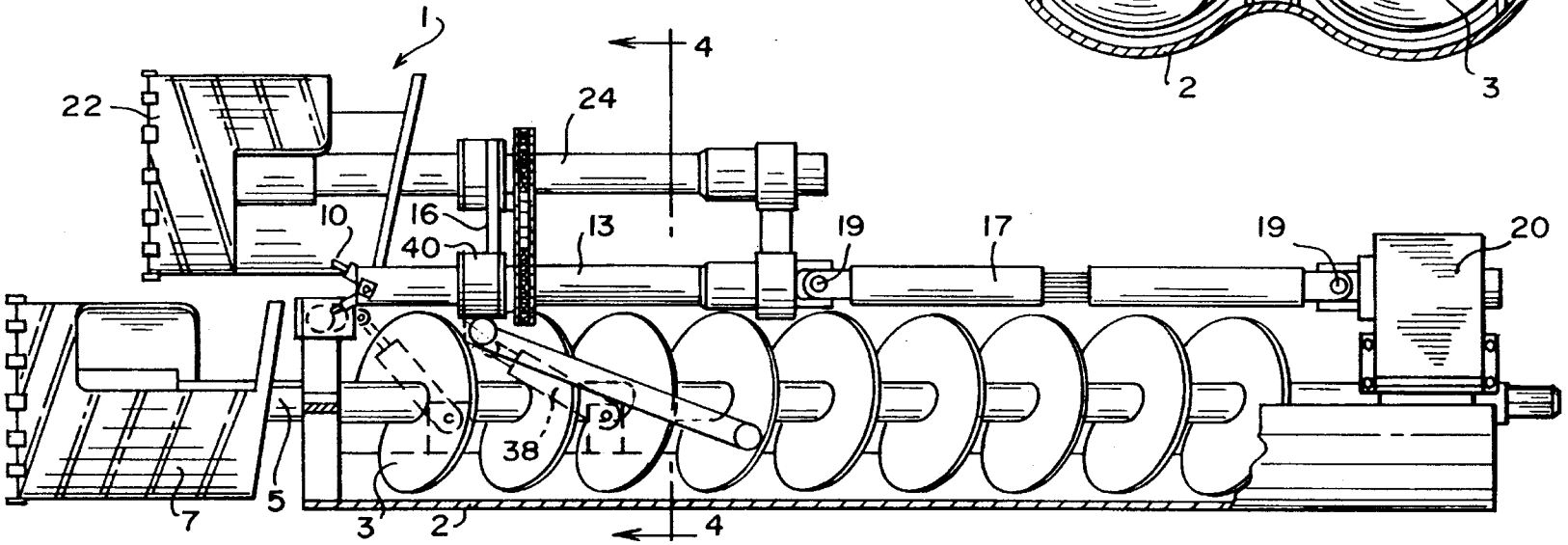
FIG. 3 is a side elevational view of the mining machine shown in FIG. 1.
Figure 14:
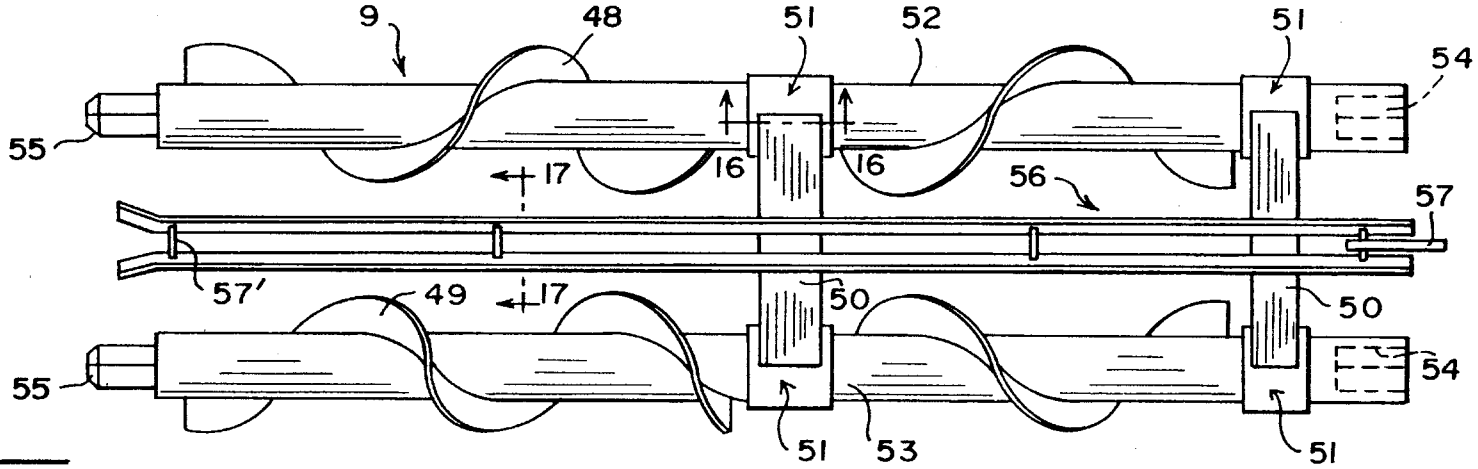
FIG. 14 is a top plan view of a thrust and torque transmitting unit employed in the mining machine of the present invention.
Figure 15:
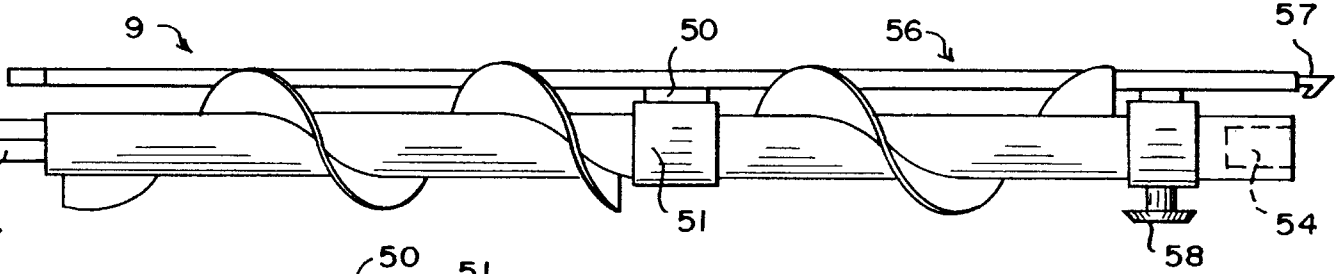
FIG. 15 is a side elevational view of the unit shown in FIG. 14.
Figure 17:
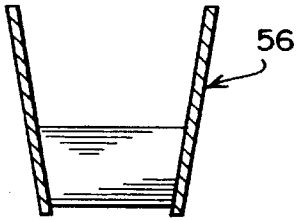
FIG. 17 is a view taken along line 17—17 of FIG. 14.
Figure 16:
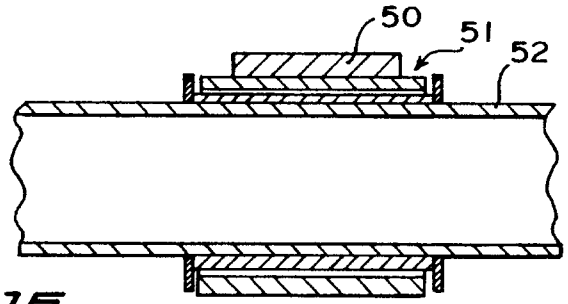
FIG. 16 is a view taken along line 16—16 of FIG. 14.

Referring to the drawings and more particularly to FIGS. 1, 2 and 3, the mining machine 1 of the present invention comprises a pan 2 having a pair of auger conveyors 3 and 4 rotatably mounted therein. The forward ends of the auger conveyor drive shafts 5 and 6 are connected to respective primary drum cutters 7 and 8, and the opposite ends of the conveyor drive shafts are adapted to be connected to a thrust and torque transmitting unit 9, FIG. 14, to be described more fully hereinafter.

A secondary set of rotary cutters 10, 11 and 12 is positioned above the primary drum cutters 7 and 8, with the outboard cutters 10 and 12 connected to each side of the pan 2 by trunnions 13. The forward end portions of drive shafts 13, 14 and 15 of the rotary cutters 10, 11 and 12 are rotatably mounted in a transversely extending plate 16, and the opposite ends of the drive shafts 13 and 15 for the outboard rotary cutters 10 and 12 are connected through flexible drive shafts 17 and 18 having universal joints 19 to gear boxes 20 and 21 mounted on the rear end of pan 2.

A third row of drum cutters 22 and 23 having drive shafts 24 and 25 (FIG. 4) is rotatably mounted in the plate 16 and is driven by a first sprocket and chain assembly 26 connected between drive shaft 13, drive shaft 24 and drive shaft 14 connected to the intermediate rotary cutter 11, and a second sprocket and chain assembly 27 connected between the outboard drive shaft 15 and shaft 25.

By this construction and arrangement, the primary or lowermost drum cutters 7 and 8 are driven by drive shafts 5 and 6 operatively connected to the thrust and torque transmission units 9 connected to a prime mover; the outboard rotary cutters 10 and 12 are driven by drive shafts 13, 15, 17 and 18 connected to gear boxes 20, 21 which, in turn, are connected to the thrust and torque transmission units 9; and the uppermost or third row of drum cutters 22 and 23, and the intermediate rotary cutter 11 are driven by the chain and sprocket assemblies 26 and 27.

Figure 11:
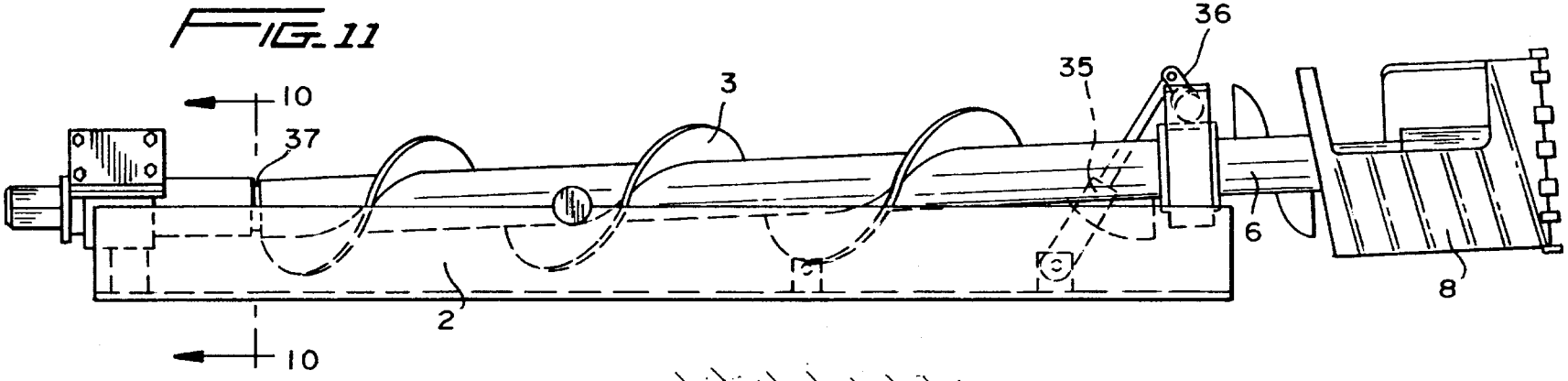
FIG. 11 is a side elevational view of the mining machine wherein the second row of rotary cutters has been removed and showing the first row or lowermost drum cutters in the elevated position.

A feature of the mining machine of the present invention is the capability of the operator to control the direction of the hole being drilled. To this end, as will be seen in FIGS. 7 and 11, the bearings 28 and 29 for the drive shafts 5 and 6 of the drum cutters 7 and 8 are provided with brackets 30 and 31 through which a transversely extending shaft 33 is rotatably mounted, the outer ends of the shaft 33 being connected to the sides of the pan 2 by eccentric bearings or journals 34. A fluid motor, such as a hydraulic cylinder 35, is connected between the bottom of the pan 2 and a link 36 connected to the shaft 33. The rear end portions of the auger drive shafts are provided with flexible couplings 37 so that when the hydraulic cylinder 35 is extended, the drum cutters 7 and 8 can be elevated in a vertical plane as shown in FIG. 11.

Figure 4:
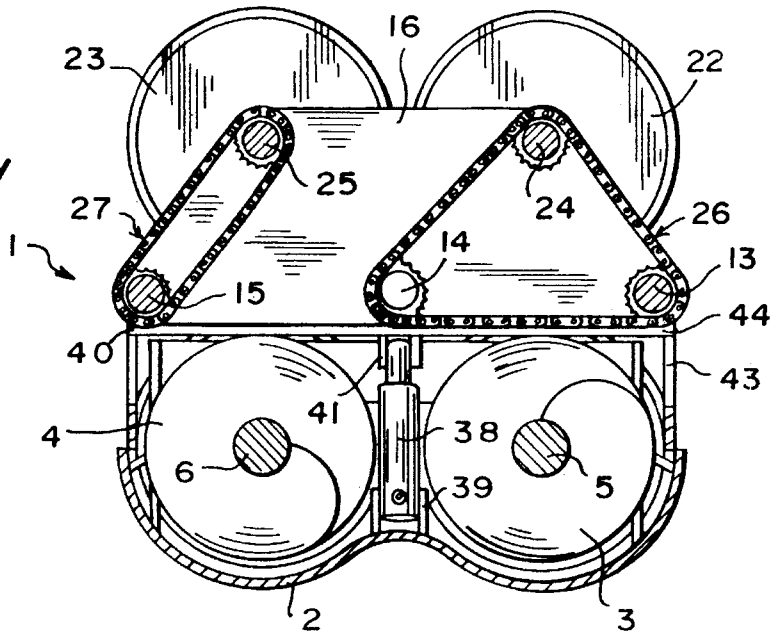
FIG. 4 is a view taken along line 4—4 of FIG. 3.

Another feature of the present invention is to allow the machine to accommodate different seam thicknesses or hole heights. As will be seen in FIGS. 3, 7 and 8, a second hydraulic cylinder 38 is pivotally connected at one end to the pan 2 as at 39 and at the other end to a transversely extending bar 40 as at 41 to which the bearings 42 for rotary cutters 10, 11 and 12 are secured. In order to stabilize the assembly, a pair of arms 43, FIGS. 1 and 4, are provided at each end of the transversely extending bar 40. One end of each arm 42 is pivotally connected to the respective end of the bar as at 44, and the other end of the arm is connected to the side of the pan 2 by a pin and slot assembly 45.

Figure 5:
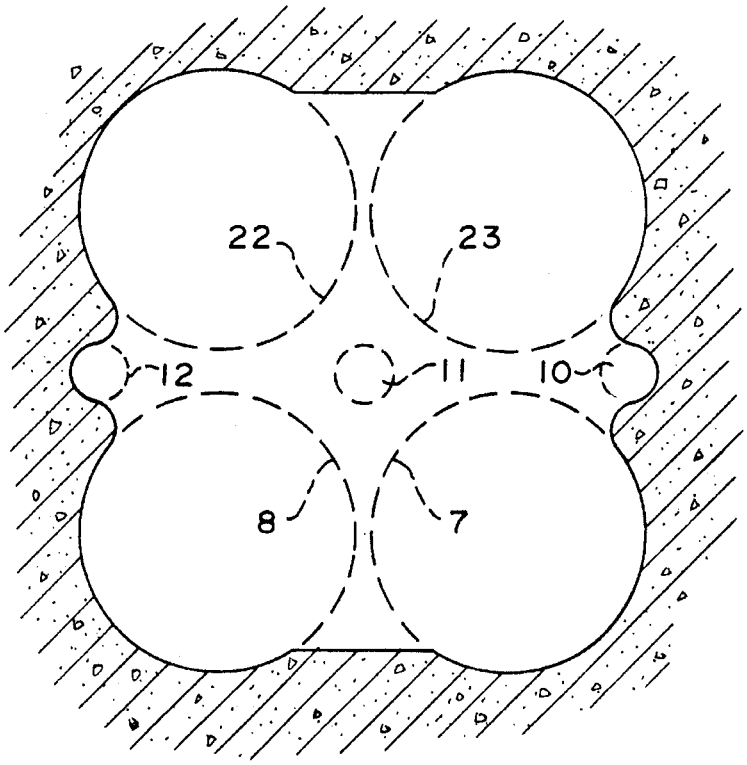
FIGS. 5 and 6 are profiles of the cut faces of a coal seam employing the mining machine of FIG. 1.
Figure 6:
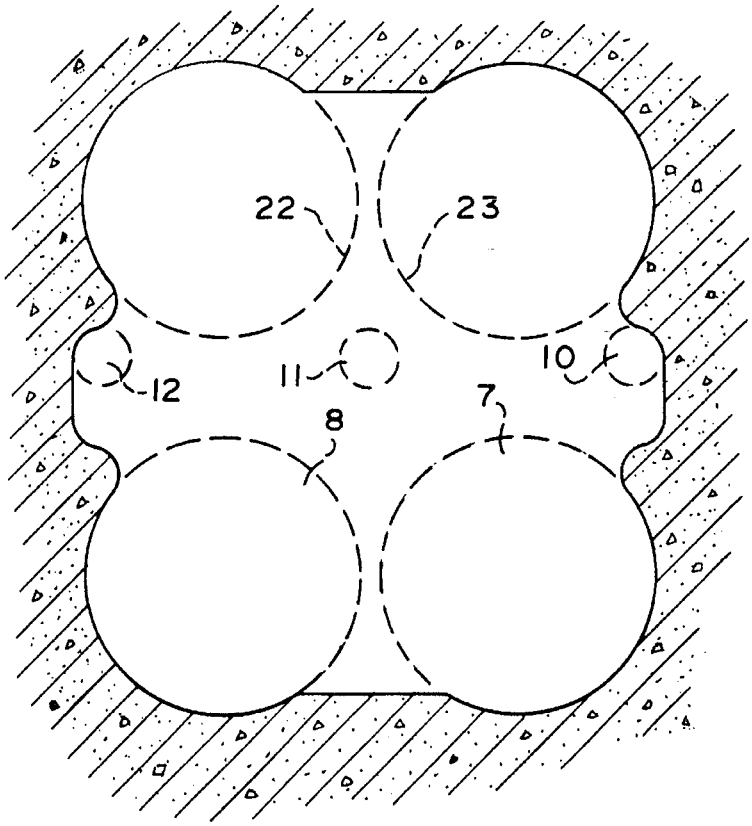

By the construction and arrangement of the pivotal movement of the lower drum cutters 7 and 8 by actuation of the hydraulic cylinder 35, and the pivotal movement of the rotary cutters 10, 11, 12, and the associated upper drum cutters 22 and 23, the face of the coal seam can be cut to a profile as shown in FIGS. 5 and 6.

Figure 7:
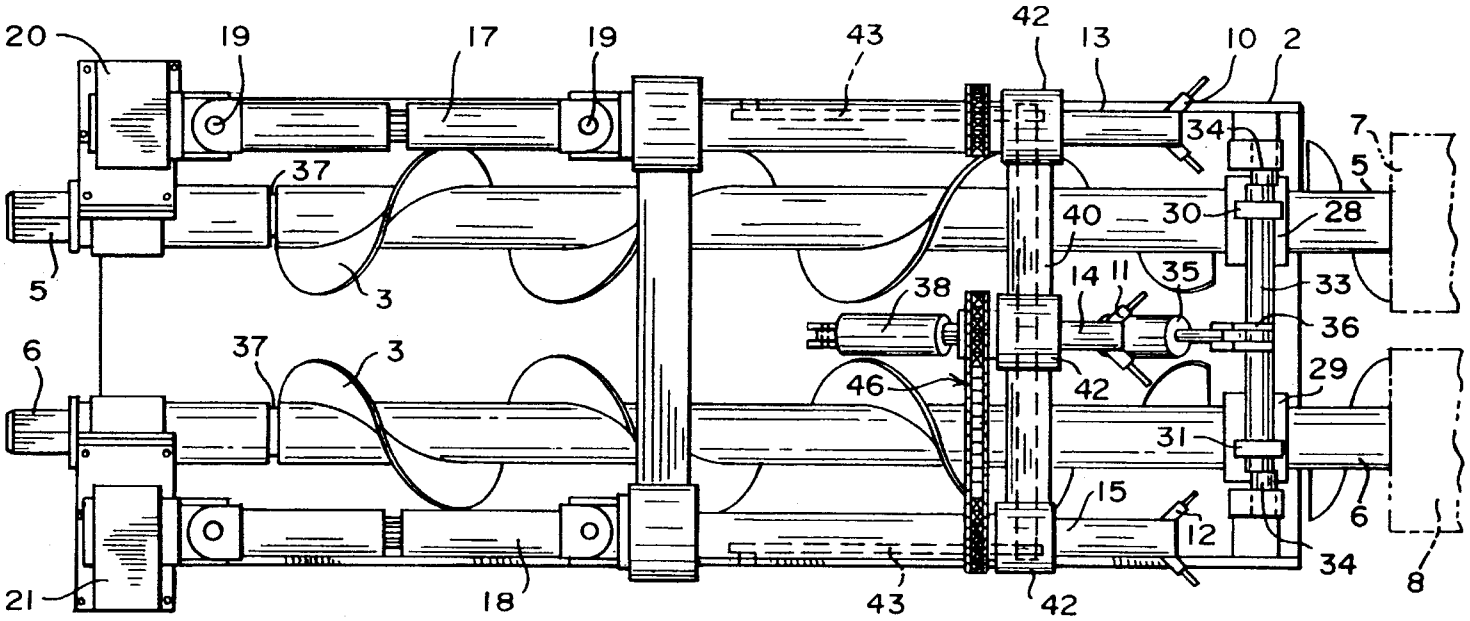
FIG. 7 is a top plan view of the mining machine of the present invention wherein the top row of cutter heads has been removed.
Figure 8:
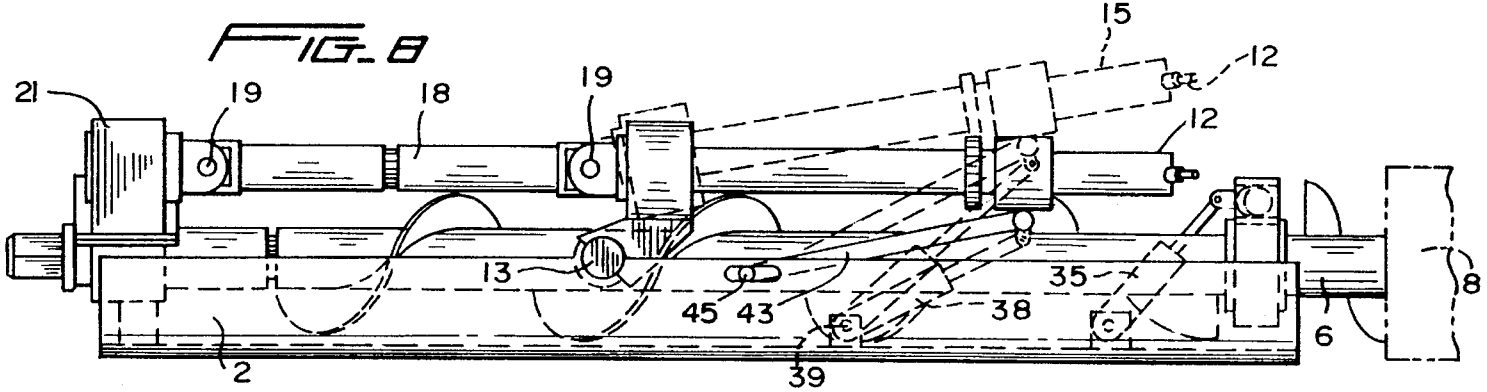
FIG. 8 is a side elevational view of the machine illustrated in FIG. 7 showing, in phantom, the second row of rotary cutters in the elevated position.
Figure 10:
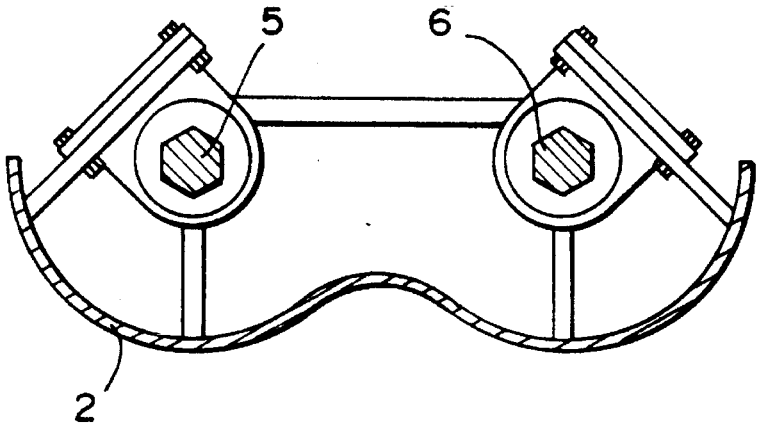
FIG. 10 is a view taken along line 10—10 of FIG. 11.
Figure 9:
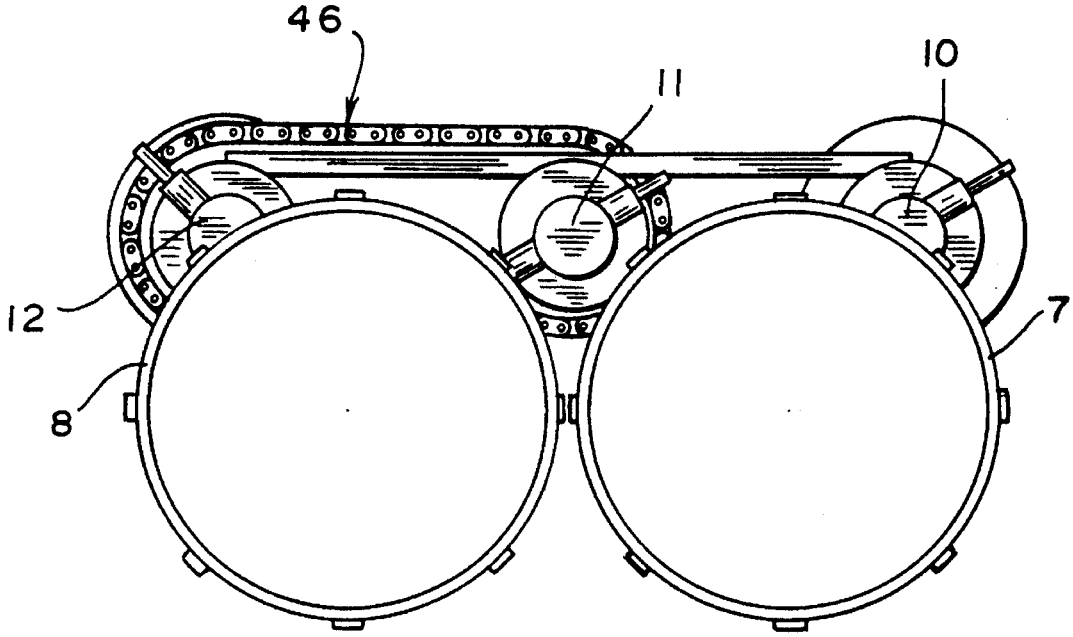
FIG. 9 is a front elevational view of the mining machine shown in FIG. 7.

In some instances, the coal seam is such that the upper or third row of drum cutters 22 and 23 is not necessary so that these drum cutters are removed from the machine by disconnecting the plate 16 carrying the drum cutter drive shafts 24 and 25, the sprocket and chain assemblies 26 and 27, and associated shaft bearings and supports, thereby providing the mining machine as shown in FIGS. 7, 8 and 9. The outboard cutters 10 and 12 are driven by drive shafts 17 and 18 and the intermediate cutter 11 is driven by a sprocket and chain assembly 46 extending between the cutter drive shafts 14 and 15. It will be appreciated by those skilled in the art that the profile of the cut face would be approximately two-thirds of that illustrated in FIGS. 5 and 6.

Figure 13:
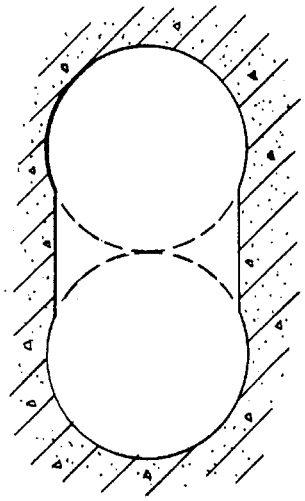
FIG. 13 is a profile of the cut face of a coal seam employing the machine of FIG. 11.
Figure 12:
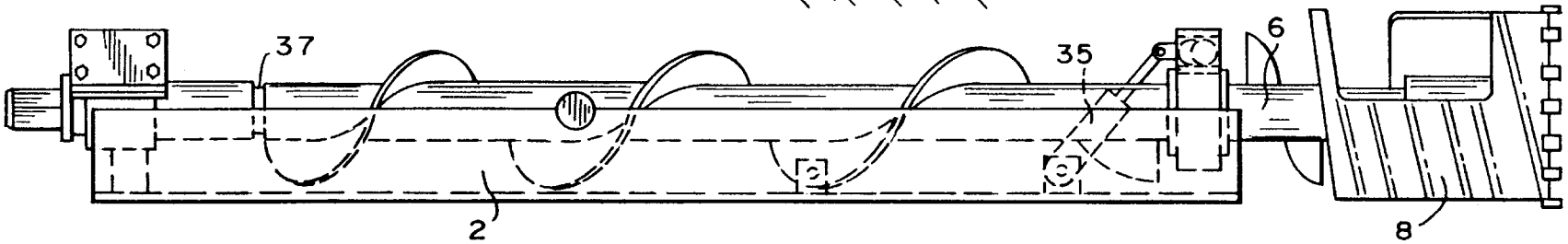
FIG. 12 is a side elevational view of the machine shown in FIG. 11 showing the drum cutters in the lowered position.

As will be seen in FIGS. 11 and 12, the rotary cutters 10, 11 and 12 and associated components can be removed from the machine leaving only the lower drum cutters 7 and 8 which would cut a profile as shown in FIG. 13.

Figure 18:
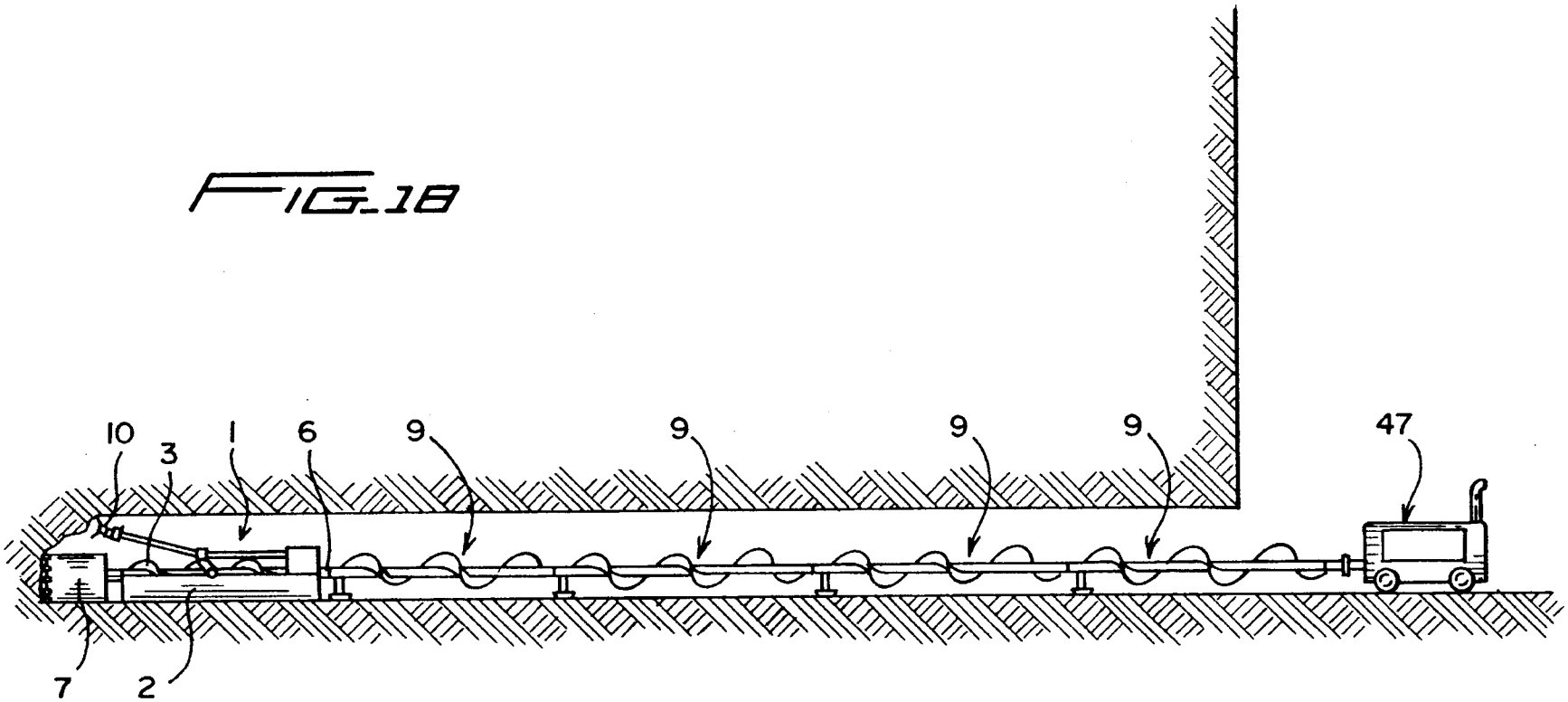
FIG. 18 is a diagrammatic side elevational view of a plurality of thrust and torque transmitting units connected end-to-end for advancing the cutters into the mine.

Referring to FIG. 18, the mining machine 1 is driven by a plurality of thrust and torque transmitting units 9, connected end-to-end between the drive shafts 5 and 6 of the auger conveyors 3 and 4 to a prime mover, such as an internal combustion engine 47 positioned outside the mine tunnel. The details of the construction of each thrust and torque transmitting unit are illustrated in FIGS. 14 to 17 and comprises a pair of helical conveyors 48, 49 held in spaced, parallel, longitudinally extending relationship by a pair of transversely extending bridge members 50, integral with a bearing 51 in which the conveyor drive shafts 52, 53 are rotatably mounted. One end of each shaft 52, 53 is provided with a socket 54 having a polygonal cross-section adapted to receive the correspondingly configured end 55 of the conveyor drive shaft of the next adjacent thrust and torque transmitting unit 9, it being understood that the sockets 54 on the first thrust and torque transmitting unit 9 will receive the shafts 5 and 6 of the auger conveyor 3. An axially extending channel 56 is positioned in the space between the helical conveyors 48 and 49 adapted to receive control cables extending between the operator and cutter heads. The channel 56 is secured to the bridge members 50, and a hook member 57 is pivotally connected to one end of the channel 56 adapted to engage a transversely extending pin 57' on the opposite end of the channel 56 on the next adjacent thrust and torque transmitting unit 9. Each thrust and torque transmitting unit 9 is provided with at least one foot member 58 for supporting the unit 9 above the mine tunnel floor, whereby less torque is required to drive the mining machine than would be required if the helical conveyors 48 and 49 were laying against the bottom and side of the tunnel while drilling.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A mining machine for mining coal from outside a hill containing a coal seam comprising, a longitudinally extending pan, a longitudinally extending auger conveyor having a drive shaft rotatably mounted in said pan, a first primary cutter connected to one end of said auger conveyor drive shaft, the opposite end of said auger conveyor drive shaft being connected to one end of a thrust and torque transmitting unit, the opposite end of the thrust and torque transmitting unit being operatively connected to a prime mover positioned outside said hill, means connected to the first primary cutter for moving the cutter in a vertical plane, to thereby allow the operator to control the direction of the hole being drilled, a secondary cutter positioned above the first primary cutter, means for detachably connecting said secondary cutter to said pan, said secondary cutter being operatively connected to said auger conveyor drive shaft and means connected to the secondary cutter for moving the cutter in a vertical plane relative to the first primary cutter, to thereby allow the machine to accomodate different seam thicknesses.

2. A mining machine according to claim 1, wherein a third cutter is positioned above the secondary cutter, said third cutter being detachably connected to said secondary cutter, and drive means extending between the secondary cutter and third cutter, whereby the third cutter is driven by the secondary cutter and movable therewith in said vertical plane.

3. A mining machine according to claim 2, wherein the third cutter comprises a pair of drum cutters.

4. A mining machine according to claim 1, wherein the means for moving the first primary cutter in the vertical plane comprises, said first primary cutter being pivotally connected to the pan along a transverse axis and a hydraulic cylinder connected between the pan and first primary cutter.

5. A mining machine according to claim 1, wherein the means for moving the secondary cutter in the vertical plane comprises, said secondary rotary cutter being pivotally connected to the pan along a transverse axis, and a hydraulic cylinder connected between the pan and the secondary rotary cutter.

6. A mining machine according to claim 1, wherein the first primary cutter comprises a pair of drum cutters, an auger conveyor being connected to each drum cutter.

7. A mining machine according to claim 1, wherein the secondary cutter comprises a plurality of rotary cutters.

8. A mining machine according to claim 1, wherein a plurality of thrust and torque transmitting units are connected end-to-end between the auger conveyor drive shaft and prime mover.

9. A mining machine according to claim 8, wherein each thrust and torque transmitting unit comprises, at least one helical conveyor having a drive shaft, one end of the drive shaft having a socket for receiving the end of the helical conveyor drive shaft in the next adjacent thrust and torque transmitting unit.

10. A mining machine according to claim 9, wherein a pair of helical conveyors are positioned in spaced, parallel longitudinally extending relationship, a bridge member extending transversely in the space between the pair of helical conveyors, a bearing connected to each end of said bridge member, said helical conveyor drive shafts being rotatably mounted in said bearings, a longitudinally extending channel secured to said bridge member for receiving control cables extending between the operator and cutter, a hook member pivotally connected to one end of said channel, and a transversely extending pin mounted on the opposite end of the channel, whereby the hook on one thrust and torque transmitting unit is adapted to engage the pin on the next adjacent thrust and torque transmitting unit whereby the plurality of thrust and torque transmitting units are held in end-to-end relationship.

* * * * *